US005538254A

United States Patent [19]

Adams

[11] Patent Number: 5,538,254

[45] Date of Patent: Jul. 23, 1996

[54] BULLET TRAP ENTERTAINMENT SYSTEM

[75] Inventor: William E. Adams, Portersville, Pa.

[73] Assignee: Adams Mfg. Corp., Portersville, Pa.

[21] Appl. No.: 511,557

[22] Filed: Aug. 4, 1995

[51] Int. Cl.[6] ..... F41J 5/04

[52] U.S. Cl. ..... 273/371; 273/410

[58] Field of Search ..... 273/371, 373, 273/377, 382, 410

[56] References Cited

U.S. PATENT DOCUMENTS

| | | | |
|---|---|---|---|
| 1,886,562 | 11/1932 | Le Fever | 273/382 |
| 3,469,843 | 9/1969 | Hubbard | 273/373 |
| 3,854,722 | 12/1974 | Ohlund et al. | 273/373 |
| 4,611,993 | 9/1986 | Brown | 434/21 |
| 4,763,903 | 8/1988 | Goodwin et al. | 273/371 |
| 4,786,058 | 11/1988 | Baughman | 273/371 |
| 4,949,972 | 8/1990 | Goodwin et al. | 273/371 |
| 5,031,920 | 7/1991 | Poierier | 273/371 |
| 5,222,740 | 6/1993 | Wu et al. | 273/371 |
| 5,259,291 | 11/1993 | Wilson | 89/36.02 |

FOREIGN PATENT DOCUMENTS 620800 8/1978 U.S.S.R. .

OTHER PUBLICATIONS

"Bullet Trap —new shotgun tester," *Popular Science,* Feb., 1978, p. 162, Feb. 1978.

*Primary Examiner*—William H. Grieb

*Attorney, Agent, or Firm*—Buchanan Ingersoll; Lynn J. Alstadt

[57] ABSTRACT

A bullet trap entertainment system for use in target shooting is disclosed. The bullet trap entertainment system may include a plurality of sensors for counting the number of accurately shot bullets and determining the velocities of the bullets, and measuring the energy transmitted in quantifiable units. The bullet trap entertainment system further includes a central processing unit for calculating a score of each user of the system and a user interface for displaying the scores. The bullet trap entertainment system may also include a collector for de-energizing and collecting the bullets entering the system.

11 Claims, 2 Drawing Sheets

BULLET TRAP ENTERTAINMENT SYSTEM

BACKGROUND OF THE INVENTION

1. Field of the Invention

This invention relates generally to bullet traps, and more particularly to a bullet trap entertainment system which calculates the velocity and total number of bullets shot into the bullet trap portion of the system.

2. Description of the Prior Art

Bullet traps are commonly used at shooting ranges, sportsman's clubs and gun clubs to de-energize potentially dangerous bullets and reduce the number of stray bullets. Bullet traps have additionally been utilized to funnel spent bullets onto a scale for measurement and easy disposal.

A number of devices have been developed to trap bullets. For example, U.S. Pat. No. 5,259,291 discloses a device having three reflective plates and a bottom surface for trapping high velocity bullets. This device also includes a tray for collecting the trapped bullets therein.

U.S. Pat. No. 5,031,920 discloses a device which includes a target chamber in front of a trap box or curtain of bullet proof material. The target is displayed on a screen and a tape recorder is utilized to save shot patterns after a number of bullets have been shot into the target.

U.S. Pat. No. 3,854,722 discloses a shooting target intended for use with electrically conductive projectiles. This shooting target includes at least two electrically conductive sheets which are connected to a scoring device. The scoring device will record hits as values which depend upon the location of the hit on the target area.

U.S. Pat. No. 3,469,843 teaches an electrical target device with impact-deforming electrodes. In particular, electrically conductive bullets cause the electrodes in the target to momentarily connect. An indicating circuit provides a visual signal to indicate the specific portion of the target that has been struck by a bullet.

Soviet Union Patent No. 620,800 teaches a target having a plurality of separate target areas wherein a bullet entering one area will be routed to a first section for collection and a bullet entering a second section will be routed to a second section for collection.

However, none of these devices provide a clock for either determining the length of time required to shoot a preselected number of bullets into the bullet trap or establishing a time reference for comparing the number of bullets shot into the bullet trap by different users within a specified time period. Further, none of these devices provide for calculating bullet velocity. The calculation of bullet velocity can be utilized to determine gun and bullet performance as well as provide an additional parameter of scoring between shooters.

It is an object of the invention to provide a bullet trap entertainment system which will receive and de-energize bullets. It is a further object of the invention to provide a bullet trap entertainment system which calculates a score based upon the shooter's speed and accuracy and bullet weight and speed. It is an additional object of the invention to provide a bullet trap entertainment system which will measure the velocity of each bullet entering the bullet trap portion of the bullet trap entertainment system.

SUMMARY OF THE INVENTION

The invention provides for a bullet trap entertainment system. In particular, the bullet trap entertainment system includes a target having a hole therein for permitting accurately shot bullets to pass into the bullet trap portion of the bullet trap entertainment system. The bullet trap entertainment system further includes a first sensor for detecting the presence of a bullet shot into the bullet trap portion of the system. The bullet trap entertainment system may also include a central processing unit for calculating a user's score and a user interface for displaying and storing all scores.

The bullet trap entertainment system may additionally include a second sensor for indicating the presence of a bullet at a second position within the bullet trap portion of the system and a clock for measuring the time interval between the first sensor and the second sensor. The central processing unit subsequently determines the velocity of the bullet from this time interval and the distance between the first sensor and the second sensor. The clock may also be used to measure the time interval between shots or the time over which a selected number of bullets are shot through the target. This information regarding the number of bullets and speed of the bullets can be combined with the weight of the bullet to give a score in weight per a unit of time.

The bullet trap entertainment system preferably includes a shield adjacent to the target for defining a straight bullet flight path through the bullet trap portion of the system and preventing deflected or inaccurately shot bullets from damaging components within the system. The bullet trap entertainment system may further include a collector for de-energizing and gathering bullets shot into the bullet trap portion of the system and a scale for measuring the total weight of the bullets if the bullet weight is not separately entered.

DETAILED DESCRIPTION OF THE PREFERRED EMBODIMENTS

Figure 1:
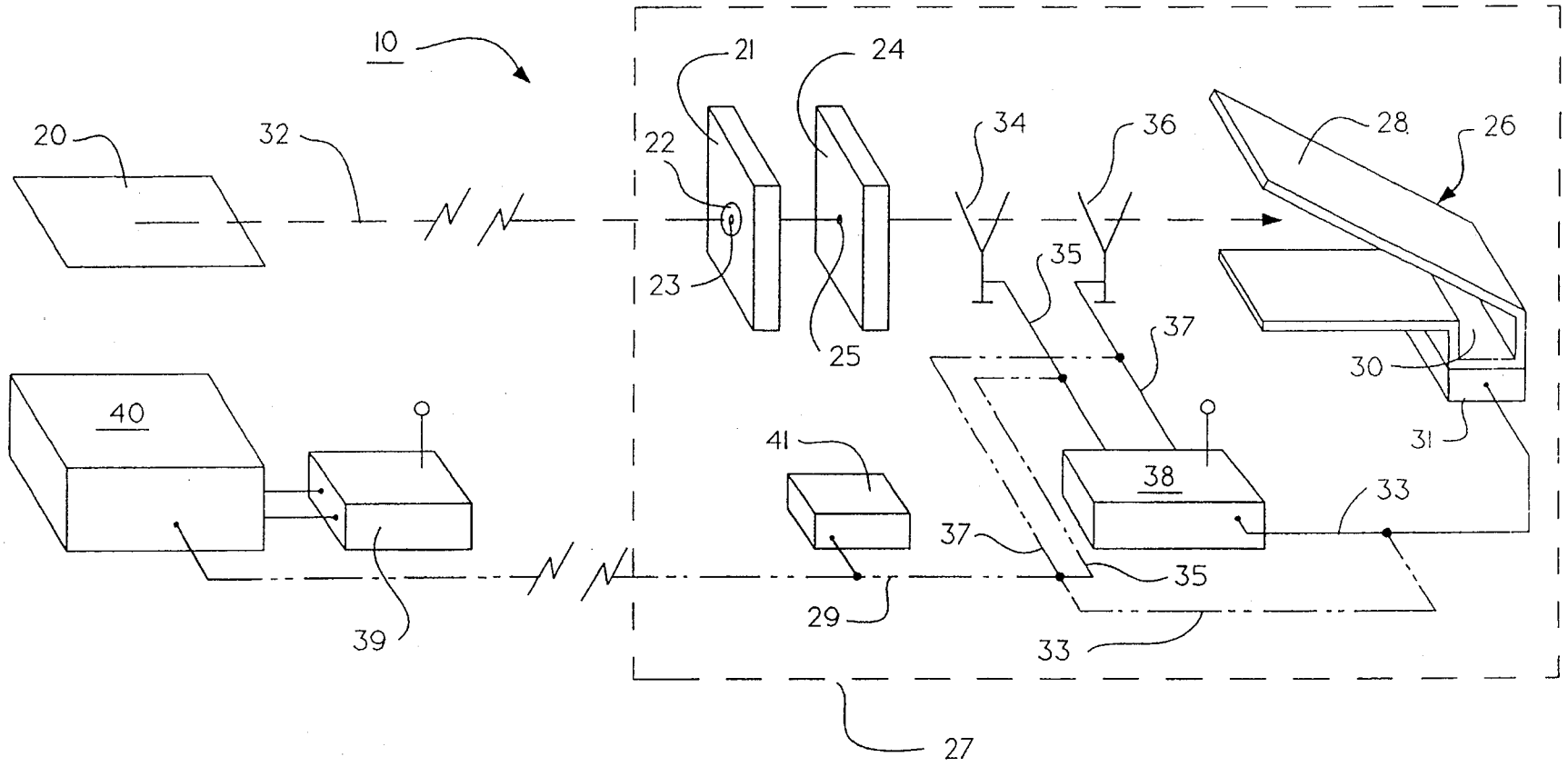
FIG. 1 is a schematic diagram of the bullet trap entertainment system.

The present preferred embodiment of FIG. 1 provides a bullet trap entertainment system 10 which weighs and counts the number of bullets entering the bullet trap portion 27 of the bullet trap entertainment system 10. The bullet trap entertainment system 10 may additionally be configured to calculate the velocity of each bullet entering the system and determine a user's score therefrom.

As shown in FIG. 1, a bullet is shot from a shooting area 20 in the direction of a target 21. The target 21 includes a first hole 23 therein for receiving an accurately fired bullet. An accurately fired bullet will pass directly into a bullet trap portion 27 of the bullet trap entertainment system 10 through the first hole 23.

A protective ring 22 is preferably positioned around the first hole 23 and is formed of hardened steel or other similar material. The protective ring 22 protects the target 21 and prevents the first hole 23 from becoming enlarged due to inaccurately fired bullets. The size of the first hole 23 and protective ring 22 may be varied depending upon the skill of the shooter. This can be done by providing a set of interchangeable protective rings having different hole sizes. The user can select the desired protective ring 22 and place that protective ring 22 into the target 21. Different sizes of rings also simulate different distances from the shooting area 20 to the target 21.

The bullet trap entertainment system 10 may additionally include a shield 24 positioned subsequent to the target 21 in a bullet flight path 32. The shield 24 has a second hole 25 therein for allowing the passage of an accurately fired bullet. The target 21 and the shield 24 define a straight horizontal bullet flight path 32 wherein an accurately fired bullet will pass through the bullet trap portion 27 of the system and strike a collector 26. Inaccurately fired bullets will either strike the target 21 or deflect off the first hole 23 and strike the shield 24. The shield 24 protects components within the bullet trap portion 27 of the bullet trap entertainment system 10 from damage from inaccurately fired bullets.

An accurately fired bullet passes through a first sensor 34 after entering the bullet trap portion 27 of the bullet trap entertainment system 10. The first sensor 34 detects the passage of the bullet and generates a first indication signal in response thereto.

The bullet trap entertainment system 10 may additionally include a second sensor 36. The second sensor 36 is positioned subsequent to the first sensor 34 in the bullet flight path 32. The second sensor 36 generates a second indication signal which corresponds to the passage of a bullet through the second sensor 36. The first indication signal and the second indication signal are preferably applied to a transmitter 38.

The shield 24 may alternatively be placed between the first sensor 34 and the second sensor 36. An increased distance between the target 21 and the shield 24 increases the accuracy required for shooting a bullet through the target 21 and the shield 24 and more refinement of the bullet flight path 32 becomes necessary.

The first hole 23 and the second hole 25 may be different sizes for increasing or decreasing the required accuracy or allowing the shooter to compensate for bullet drop when the target 21 and the shield 24 are separated by a great distance or when very low speed projectiles are used.

The bullet trap entertainment system 10 may further include a fan 41 adjacent to the bullet flight path 32. The fan 41 duplicates wind deflection found on a target range and the fan 41 speed may be controlled and varied by the central processing unit 50.

After passing through the first sensor 34 and the second sensor 36, an accurately fired bullet enters the collector 26 and is subsequently de-energized. In particular, the bullet strikes a deflector plate 28 in the collector 26 and is deflected into a reservoir 30. The deflector plate 28 is preferably constructed of hardened steel or similar material in order to withstand numerous firings.

The bottom portion of the reservoir 30 may be configured to include a scale 31 wherein de-energized bullets are deflected into the reservoir 30 and onto the scale 31. The bullets are subsequently weighed by the scale 31 and a scale output signal is thereafter generated.

The scale output signal and the first indication signal and the second indication signal are respectively directed through wires 33, 35 and 37 to the transmitter 38. The transmitter 38 transmits the first indication signal, second indication signal and scale output signal to a receiver 39. The signals may be transmitted via radio frequency, infrared or other suitable carrier. The receiver 39 applies the received signals to a user interface 40. Alternatively, the wires 33, 35 and 37 may be hard wired to a transmission wire 29 for direct transmission of the first indication signal, second indication signal and scale output signal to the user interface 40 as shown in FIG. 1.

The user interface 40 preferably adjoins the corresponding shooting area 20 as shown in FIG. 1. Alternatively, the user interface 40 may be positioned adjacent to the bullet trap portion 27 of the bullet trap entertainment system 10 or at any other location within the shooter's range of sight or sound.

Figure 2:
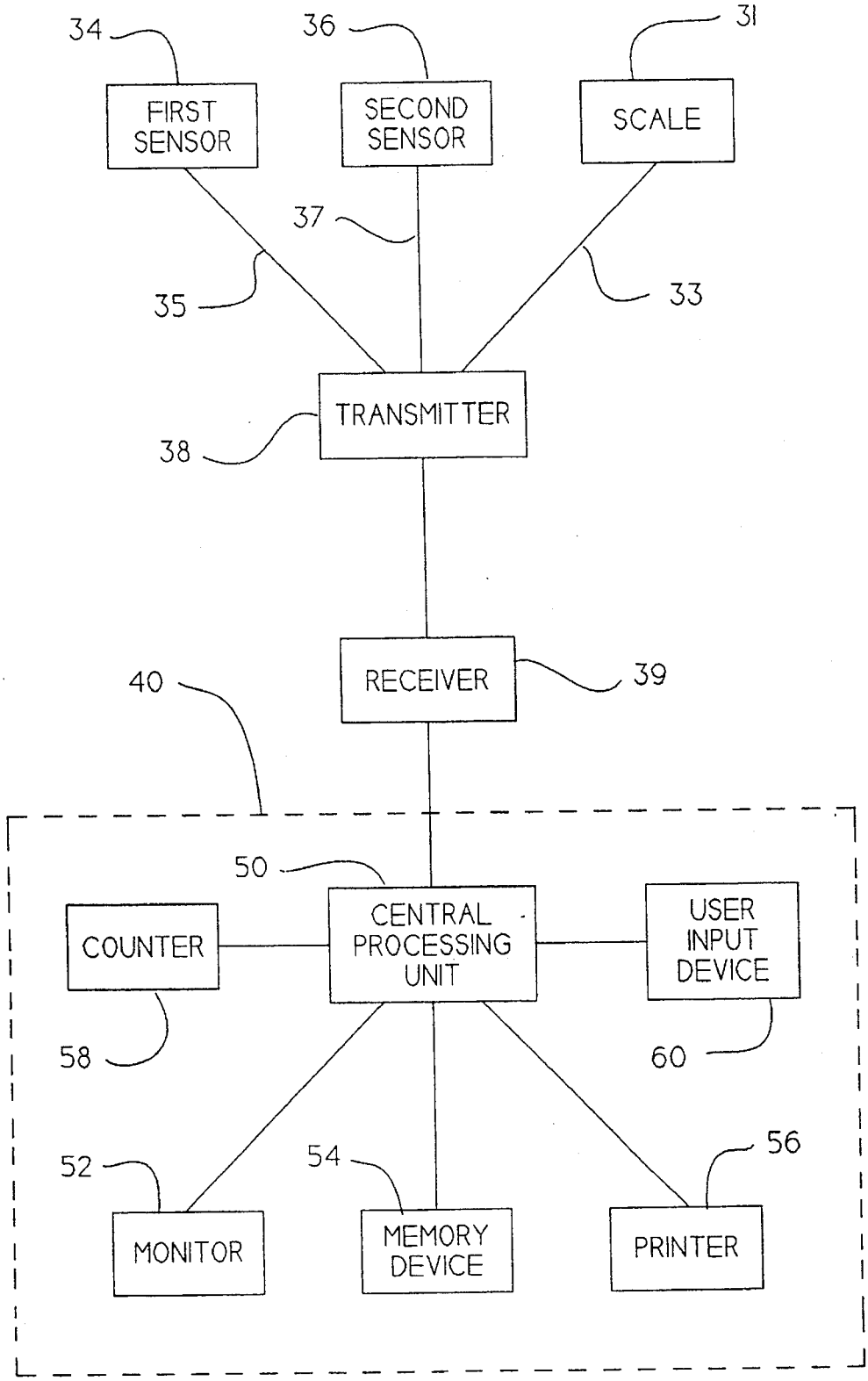
FIG. 2 is a functional block diagram of the bullet trap entertainment system.

The user interface 40 preferably includes a central processing unit 50 and a clock 58 as shown in FIG. 2. The central processing unit 50 reads and processes data from the first indication signal, second indication signal and scale output signal.

The central processing unit 50 is configured to count the number of bullets that have passed through the first sensor 34. In addition, the central processing unit 50 may calculate the velocity of each bullet based upon the length of time between the first indication signal and the second indication signal and the distance between the first sensor 34 and the second sensor 36. The average velocity of all bullets shot into the bullet trap portion 27 may also be calculated by the central processing unit 50. The central processing unit 50 utilizes the bullet count and velocity information to calculate a shooter's score.

The bullet trap entertainment system 10 may be configured for different modes of competitive operation between users. In a first mode of operation, the central processing unit 50 reads data from the first indication signal for a preselected period of time (e.g. 10, 20 or 30 seconds) which is measured by the clock 58. Therefore, the bullet trap entertainment system 10 may be used to count the number of bullets that pass through the bullet trap portion 27 of the system within a preselected period of time. This mode of operation tests the speed and accuracy of a shooter.

In a second mode of operation, the central processing unit 50 counts the number of bullets that have passed through the bullet trap portion 27 of the system until a preselected number of bullets have been counted. The central processing unit 50 utilizes the clock 58 to determine the length of time required to shoot a preselected number of bullets into the bullet trap portion 27 of the system. Similar to the first mode of operation, this mode also tests a shooter's speed and accuracy in target shooting.

In a third mode of operation, the speed of each bullet is multiplied by the number of bullets and the bullet weight in order to determine the total amount of energy that has hit the collector 26. Additional computations similar to the above can determine loss of bullet mass as a result of passing through the air at high velocities as well as other quantifiable aspects of shooting and measuring energy transmission of bullets, arrows, crossbow bolts and other projectiles.

The user interface 40 may additionally include a user input device 60, a monitor 52, a memory device 54 and a printer 56 connected to the central processing unit 50 as shown in FIG. 2. The user input device 60 may be utilized to input information that is personal to the particular shooter. For example, the user could input his name, age, skill level, shooting position, distance from the target, gun type and bullet weight.

The central processing unit 50 is configured to calculate a user's score based upon a number of parameters and the particular mode of operation. The bullet trap entertainment system 10 may further include handicaps determined from the user's personal information. Average scores or "par" may also be preset and continuously updated by the bullet trap entertainment system 10 to inform a user of his skill level compared to average shooters.

The score in the first mode of operation is calculated from the total number of bullets shot into the bullet trap portion 27 of the system within the preselected period of time. The score in the second mode of operation would be based upon the length of time required to shoot a preselected number of bullets into the bullet trap portion 27 of the bullet trap entertainment system 10. The score in the third mode of operation is calculated by multiplying the number of bullets shot into the bullet trap portion 27 of the system by the weight in grains of each bullet and the velocity of each bullet. The score could alternatively be determined by multiplying the number of bullets shot into the bullet trap portion 27 by the weight of the bullets. The weight of the bullets may be determined from the scale 31 or specified by the user via the user input device 60.

Regardless of the mode of operation, the central processing unit 50 subsequently conveys the user's score to the shooter via the monitor 52. The monitor 52 may also include an audio speaker adjacent to the shooting area 20. The user's score may be visually and audibly conveyed to the shooter via the monitor 52.

The central processing unit 50 may further utilize the memory device 54 to store each shooter's score. The central processing unit 50 may additionally be configured to rank all of the users of the bullet trap entertainment system 10. The individual scores and rankings may be displayed via the monitor 52. Furthermore, the user interface 40 may further include a printer 56 for providing a hard copy of each shooter's score as well as the final rankings of the shooters.

Although certain preferred embodiments have been described and shown herein, it is to be understood that various other embodiments and modifications can be made within the scope of the following claims.

I claim:

1. A bullet trap entertainment system for receiving a plurality of accurately aimed bullets and calculating a score therefrom, comprising:

a. a target having a first hole therein for allowing a passage of the bullets therethrough;

b. a first sensor for detecting a passage of individual bullets at a first position and said first sensor being positioned subsequent to said target in a bullet flight path;

c. a central processing unit for computing the score of a user of said bullet trap entertainment system and said central processing unit being connected to said first sensor; and d. a user interface for conveying the score to the user of said bullet trap entertainment system and said user interface being connected to said central processing unit.

2. The bullet trap entertainment system of claim 1 further comprising a clock for measuring a period of time and said clock being connected to said central processing unit.

3. The bullet trap entertainment system of claim 1 further comprising a collector for de-energizing the bullets shot through said target and said collector being positioned subsequent to said first sensor in the bullet flight path.

4. The bullet trap entertainment system of claim 3 further comprising a scale for receiving and weighing the bullets de-energized by said collector and said scale being connected to said central processing unit.

5. The bullet trap entertainment system of claim 1 further comprising a second sensor for detecting a passage of individual bullets at a second position and said second sensor being positioned subsequent to said first sensor in the bullet flight path and said second sensor being connected to said central processing unit.

6. The bullet trap entertainment system of claim 5 further comprising:

a. a transmitter for transmitting bullet detection information of said first sensor and said second sensor and said transmitter being connected to said first sensor and said second sensor; and b. a receiver for receiving the bullet detection information and said receiver being connected to said central processing unit.

7. The bullet trap entertainment system of claim 1 further comprising a shield having a second hole therein for defining the bullet flight path and said shield being interposed between said target and said first sensor in the bullet flight path.

8. The bullet trap entertainment system of claim 1 further comprising a protective ring surrounding the first hole in said target.

9. The bullet trap entertainment system of claim 1 further comprising a fan for altering the bullet flight path.

10. The bullet trap entertainment system of claim 1 wherein said user interface includes at least one of:

a. an input device for introducing user information into said bullet trap entertainment system;

b. a monitor for conveying the score of the user of said bullet trap entertainment system;

c. a printer for creating a hard copy of the score of the user of said bullet trap entertainment system; and d. a memory device for storing the score of the user of said bullet trap entertainment system.

11. The bullet trap entertainment system of claim 10 further comprising:

a. a shield having a second hole therein for defining the bullet flight path and said shield being interposed between said target and said first sensor in the bullet flight path;

b. a second sensor for detecting a passage of individual bullets at a second position and said second sensor being positioned subsequent to said first sensor in the bullet flight path and said second sensor being connected to said central processing unit;

c. a collector for de-energizing the bullets shot through said target and said collector being positioned subsequent to said second sensor in the bullet flight path;

d. a scale for receiving and weighing the bullets de-energized by said collector and said scale being connected to said central processing unit;

e. a clock for measuring a period of time and said clock being connected to said central processing unit; and f. a fan for altering the bullet flight path.

* * * * *